US010557294B2

(12) United States Patent
Guillemette

(10) Patent No.: US 10,557,294 B2
(45) Date of Patent: Feb. 11, 2020

(54) MULTIPOINT DOOR LOCKING SYSTEM

(71) Applicant: Christian Guillemette, Beauport (CA)

(72) Inventor: Christian Guillemette, Beauport (CA)

( * ) Notice: Subject to any disclaimer, the term of this patent is extended or adjusted under 35 U.S.C. 154(b) by 52 days.

(21) Appl. No.: 15/763,746

(22) PCT Filed: Oct. 19, 2016

(86) PCT No.: PCT/IB2016/056296
§ 371 (c)(1),
(2) Date: Mar. 27, 2018

(87) PCT Pub. No.: WO2017/068518
PCT Pub. Date: Apr. 27, 2017

(65) Prior Publication Data

US 2019/0017305 A1 Jan. 17, 2019

Related U.S. Application Data

(60) Provisional application No. 62/245,030, filed on Oct. 22, 2015.

(51) Int. Cl.
*E05C 3/24* (2006.01)
*E05B 17/20* (2006.01)
(Continued)

(52) U.S. Cl.
CPC ..... *E05C 3/24* (2013.01); *E05B 17/2007* (2013.01); *E05B 17/2038* (2013.01);
(Continued)

(58) Field of Classification Search
CPC ..... E05C 3/24; E05C 9/043; E05B 65/0046; E05B 85/243; E05B 17/2007;
(Continued)

(56) References Cited

U.S. PATENT DOCUMENTS 3,758,142 A * 9/1973 Gartner ..... E05B 47/0696 292/254
4,529,234 A * 7/1985 Senften ..... E05B 47/0046 292/150

(Continued)

FOREIGN PATENT DOCUMENTS

CN 102182364 A 9/2011
WO 2010107468 A1 9/2010

OTHER PUBLICATIONS

International Search Report of PCT/IB2016/056296; Pengfei Zhang; dated Jan. 25, 2017.

(Continued)

*Primary Examiner* — Nathan Cumar
(74) *Attorney, Agent, or Firm* — BCF LLP

(57) ABSTRACT

A multipoint door lock system for a door having on its edge a deadbolt and a secondary bore is disclosed. The system includes a door frame. A pivotable latch mounted in the door frame has a door-locking tip that enters the secondary bore of the door when the door is closed. Insertion of the deadbolt in a bolt opening of the door frame causes a lever to move from a resting position, displacing a translating member mounted in the door frame to an extended position. A distal end of the translating member enters a recess of the pivotable latch, locking the pivotable latch. The system may include a pair of translating members and a pair of pivotable latches having door-locking tips entering corresponding secondary bores of the door. A combination of the multipoint door lock system with the door is also disclosed.

19 Claims, 18 Drawing Sheets

(51) Int. Cl.
*E05B 63/00* (2006.01)
*E05B 63/24* (2006.01)
*E05C 9/04* (2006.01)

(52) U.S. Cl.
CPC ..... *E05B 63/0052* (2013.01); *E05B 63/242* (2013.01); *E05C 9/043* (2013.01)

(58) Field of Classification Search
CPC ..... E05B 15/0046; E05B 15/0086; E05B 67/383; E05B 17/2038; E05B 17/63; E05B 17/0052; E05B 47/0046; E05B 65/0829; E05B 65/0847; E05B 65/0882; E05B 63/242
USPC ..... 292/216
See application file for complete search history.

(56) References Cited

U.S. PATENT DOCUMENTS 4,679,834 A * 7/1987 Gotanda ..... E05B 63/248 292/169.13
4,840,050 A * 6/1989 Gotanda ..... E05B 47/0046 292/169.13
2008/0078216 A1* 4/2008 Fleming ..... E05B 15/004 70/113
2008/0156048 A1* 7/2008 Topfer ..... E05B 65/1086 70/77

OTHER PUBLICATIONS

English Translation of CN102182364A received from the ISA/CA; retrieved on Jan. 25, 2017.

* cited by examiner

MULTIPOINT DOOR LOCKING SYSTEM

TECHNICAL FIELD

The present disclosure relates to the field of door locks. More specifically, the present disclosure relates to a multipoint door locking system.

BACKGROUND

One of the most commonly used types of locks securing doors in residential and commercial applications is the deadbolt. As is well-known, a deadbolt can only be moved between its retracted (unlocked) and extended (locked) positions by rotating a lock cylinder with a key. The deadbolt, when in its extended position, penetrates into a bolt opening of a door frame. It is difficult to defeat a deadbolt by so-called "jimmying" action. Regardless, most doors locked with deadbolts can be opened by exerting on such door a brute force sufficient to break the frame in the bolt opening area.

Conventional multipoint door locks alleviate this problem by providing additional elements that extend from the door into the door frame when locked. The amount of force required to overcome multipoint door locks is multiplied in view of the number of additional elements.

However, conventional multipoint door locks are expensive in part because they require important modifications to the doors on which they are installed. In fact, many doors cannot be modified to accommodate the installation of conventional multipoint door locks. When it is possible to install a conventional multipoint door lock on an existing door, this can only be achieved through a labor-intensive process. Some doors are provided with factory-installed multipoint door locks; however the cost of these doors is usually prohibitive Therefore, there is a need for techniques that compensate for above described limitations of conventional multipoint door locks.

SUMMARY

According to the present disclosure, there is provided a multipoint door lock system for a door having on its edge a deadbolt and a secondary bore separated from the deadbolt. The system comprises a door frame, a pivotable latch, a lever and a translating member. The door frame has a strike jamb, a bolt opening provided in the strike jamb being adapted to receive the deadbolt, the strike jamb having a secondary opening positioned to face the secondary bore of the door when the door is closed in the door frame. The pivotable latch has a locking recess, a door-actuated tip and a door-locking tip. The pivotable latch is mounted in the door frame so that the door-actuated tip can protrude through the secondary opening of the strike jamb as the pivotable latch rotates. The pivotable latch is configured to rotate when the edge of the door pushes the door-actuated tip into the door frame, causing the door-locking tip to enter in the secondary bore of the door. The lever is mounted in the door frame and is movable between a resting position facing the bolt opening when the deadbolt is not inserted in the bolt opening and a locking position adjacent to the resting position when the deadbolt is inserted in the bolt opening. The translating member has a proximal end operatively connected to the lever and a distal end extending toward the locking aperture of the pivotable latch. The translating member takes a retracted position when the lever is in the resting position, leaving the distal end of the translating member outside the locking recess of the pivotable latch. The translating member takes an extended position when the lever is in the locking position, inserting the distal end of the translating member in the locking recess to lock the pivotable latch.

According to the present disclosure, there is also provided a multipoint door lock system. The system comprises a door, a door frame, a pivotable latch, a lever and a translating member. The door has on its edge a deadbolt and a secondary bore separated from the deadbolt. The door frame has a strike jamb, a bolt opening provided in the strike jamb being adapted to receive the deadbolt, the strike jamb having a secondary opening positioned to face the secondary bore of the door when the door is closed in the door frame. The pivotable latch has a locking recess, a door-actuated tip and a door-locking tip. The pivotable latch is mounted in the door frame so that the door-actuated tip can protrude through the secondary opening of the strike jamb as the pivotable latch rotates. The pivotable latch is configured to rotate when the edge of the door pushes the door-actuated tip into the door frame, causing the door-locking tip to enter in the secondary bore of the door. The lever is mounted in the door frame and is movable between a resting position facing the bolt opening when the deadbolt is not inserted in the bolt opening and a locking position adjacent to the resting position when the deadbolt is inserted in the bolt opening. The translating member has a proximal end operatively connected to the lever and a distal end extending toward the locking aperture of the pivotable latch. The translating member takes a retracted position when the lever is in the resting position, leaving the distal end of the translating member outside the locking recess of the pivotable latch. The translating member takes an extended position when the lever is in the locking position, inserting the distal end of the translating member in the locking recess to lock the pivotable latch.

According to the present disclosure, there is also provided a multipoint door lock system for a door having on its edge a deadbolt and a secondary bore separated from the deadbolt. The system comprises a door frame, a pivotable latch, a lever and a translating member. The pivotable latch is mounted in the door frame and has a door-locking tip configured to enter the secondary bore of the door through a secondary opening of the door frame when the door is closed in the door frame. The lever is mounted in the door frame and is configured to move from a resting position to a locking position upon insertion of the deadbolt in a bolt opening of the door frame. The translating member is mounted in the door frame and has a proximal end operatively connected to the lever. The translating member is configured to move from a retracted position to an extended position when the lever is moved to the locking position, a distal end of the translating member locking the pivotable latch to prevent the door-locking tip from exiting the secondary bore of the door when the deadbolt is inserted in the bolt opening.

The present disclosure further introduces a multipoint door lock system. The system comprises a door, a door frame, a pivotable latch, a lever and a translating member. The door has on its edge a deadbolt and a secondary bore separated from the deadbolt. The pivotable latch is mounted in the door frame and has a door-locking tip configured to enter the secondary bore of the door through a secondary opening of the door frame when the door is closed in the door frame. The lever is mounted in the door frame and is configured to move from a resting position to a locking position upon insertion of the deadbolt in a bolt opening of the door frame. The translating member is mounted in the door frame and has a proximal end operatively connected to the lever. The translating member is configured to move from a retracted position to an extended position when the lever is moved to the locking position, a distal end of the translating member locking the pivotable latch to prevent the door-locking tip from exiting the secondary bore of the door when the deadbolt is inserted in the bolt opening.

The present disclosure further relates to a multipoint door lock system for a door having on its edge a deadbolt and a secondary bore separated from the deadbolt. The system comprises a door frame, a latch and a translating member. The door frame has a bolt opening adapted for insertion of the deadbolt and a secondary opening. The latch is mounted in the door frame. The latch takes an activable position when the door is opened and a pre-armed position when the door is closed. A door-locking tip of the latch protrudes from a secondary opening of the door frame and into the secondary bore when the door is closed. The translating member is mounted in the door frame and is actuated by insertion of the deadbolt in the bolt opening to lock the pivotable latch in its pre-armed position within the secondary bore.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

Like numerals represent like features on the various drawings.

DETAILED DESCRIPTION

Various aspects of the present disclosure generally address one or more of the deficiencies of conventional multipoint door locks.

Generally speaking, elements of the present multipoint door lock are integrated in a door frame, more specifically in a subframe that can be mounted on a conventional door frame. An ordinary door provided with a deadbolt is mounted in the subframe. The ordinary door is modified with the simple cutting of one or more additional bores, or secondary bores, on its edge, separated from the deadbolt. One or more pivotable latches are provided in the subframe, each pivotable latch corresponding to one secondary bore. The pivotable latches protrude through the subframe in secondary openings that will face the secondary bores of the door when the door is closed in its door frame. When the door is open, door-actuated tips of the pivotable latches protrude from the door frame; in some embodiments, the pivotable latches may pivot freely in the subframe. Upon closing the door, the edge of the door activates the pivotable latches by pushing on the door-actuated tips, causing a rotation of the pivotable latches. The door-actuated tips penetrate into the door frame, causing door-locking tips of the pivotable latches to protrude from the door frame and enter in the secondary bores of the door. Though the door-locking tips are now positioned in the secondary bores, the door remains unlocked because the pivotable latches will easily rotate, causing the door-locking tips to re-enter the door frame and the door-actuated tips to protrude again from the door frame if the door is opened. When the door is closed, the position of the door-locking tips of the latches within the secondary bores of the door effectively pre-arms the multipoint door lock without however preventing normal, keyless opening of the door because the door is yet locked when the multipoint door lock is in this pre-armed condition. Upon locking of the door, the deadbolt pushes on a lever provided in a bolt opening of the subframe. This lever displaces one or more translating members that lead toward the pivotable latches. A tip of each translating member penetrates in a recess of the pivotable latches, preventing their rotation. At that time, the deadbolt and the pivotable latches each form a locking point for the door. The pivotable latches now effectively lock the door without moving from their pre-armed positions. Unlocking the door causes the deadbolt to exit from the bolt opening of the subframe. The translating members are pulled back, their tip no longer locking the pivotable latches that however maintain their pre-armed positions until the door is opened again.

Figure 2:
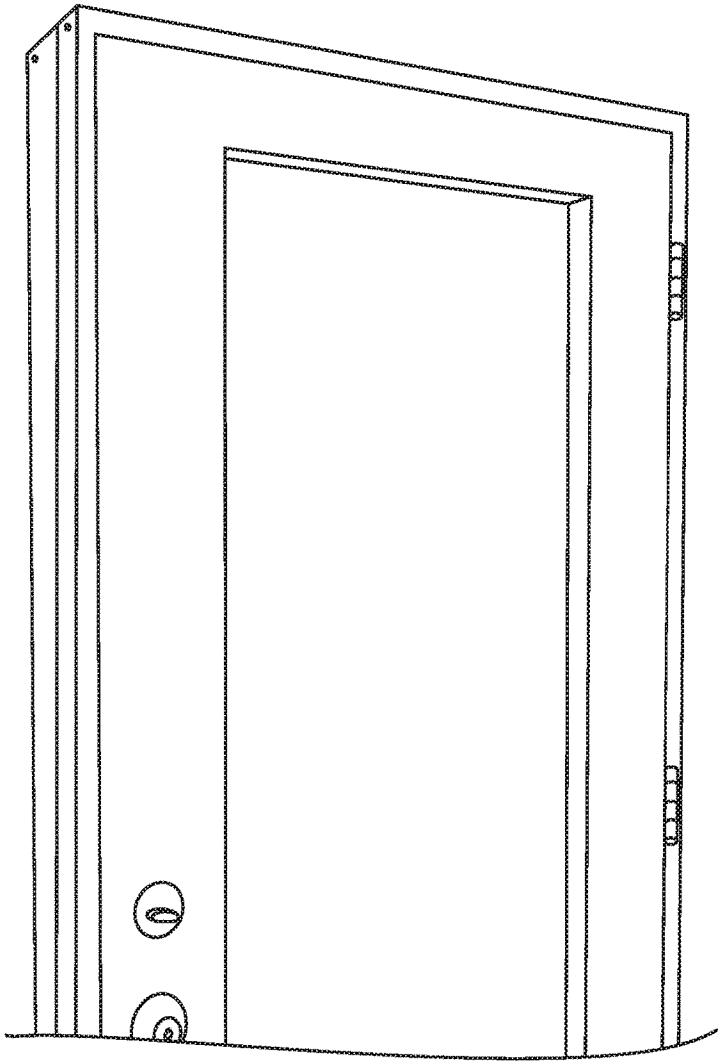
FIG. 2 is a perspective, partial view of a door mounted in a conventional door frame.
Figure 1:
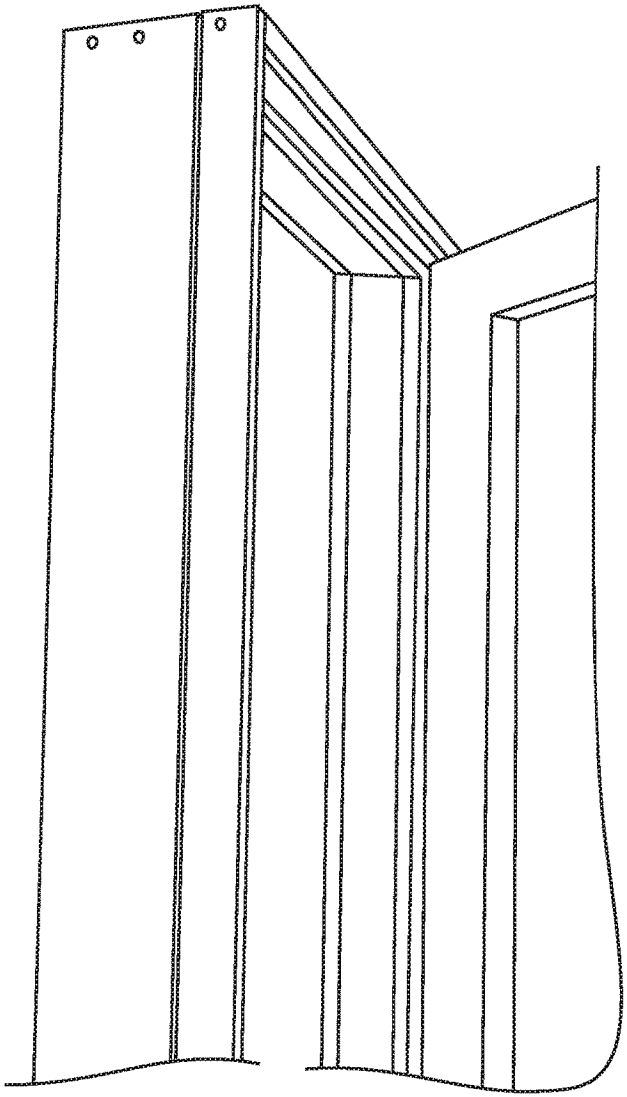
FIG. 1 is a perspective, partial view of a conventional door frame.

Referring now to the drawings, FIG. 1 is a perspective, partial view of a conventional door frame. FIG. 2 is a perspective, partial view of a door mounted in a conventional door frame. A door is mounted in a door frame 7, for example but not exclusively a wooden frame, having a width corresponding to a depth of a wall in which the door and the door frame 7 will be mounted. When closed, the door is generally flush with an internal face of the door frame 7.

Figure 4:
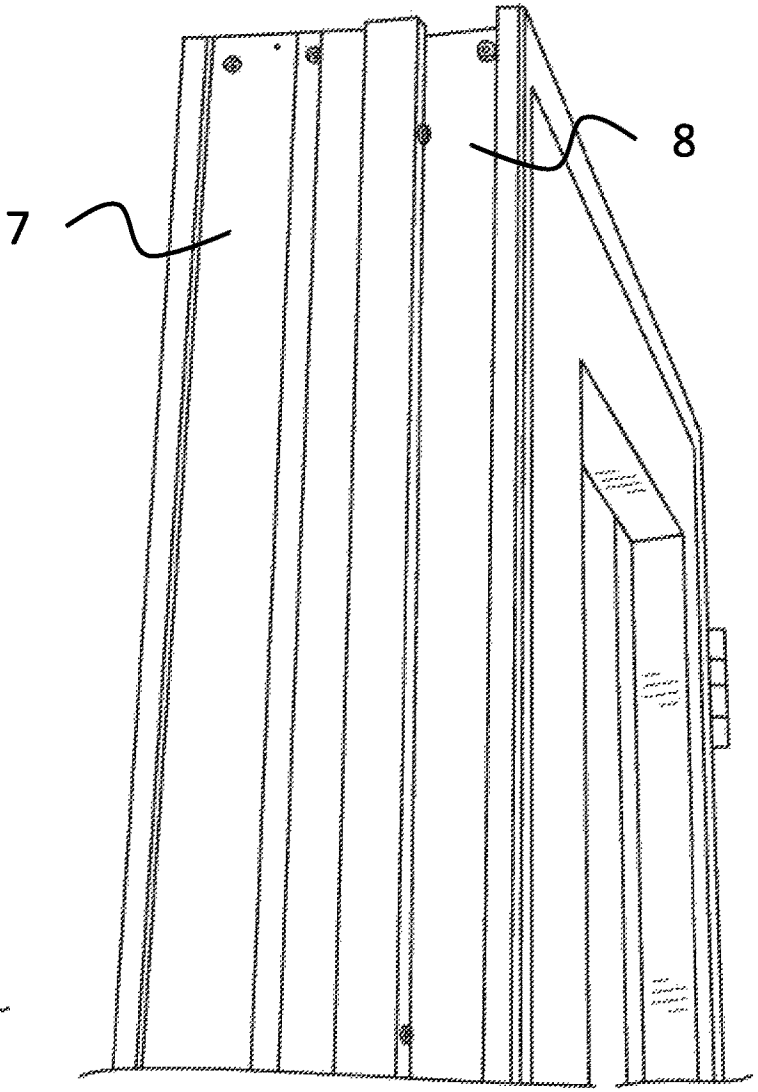
FIG. 4 is a perspective view of a subframe according to an embodiment, mounted on the frame of FIG. 1 after the conventional door frame has been cut.
Figure 3:
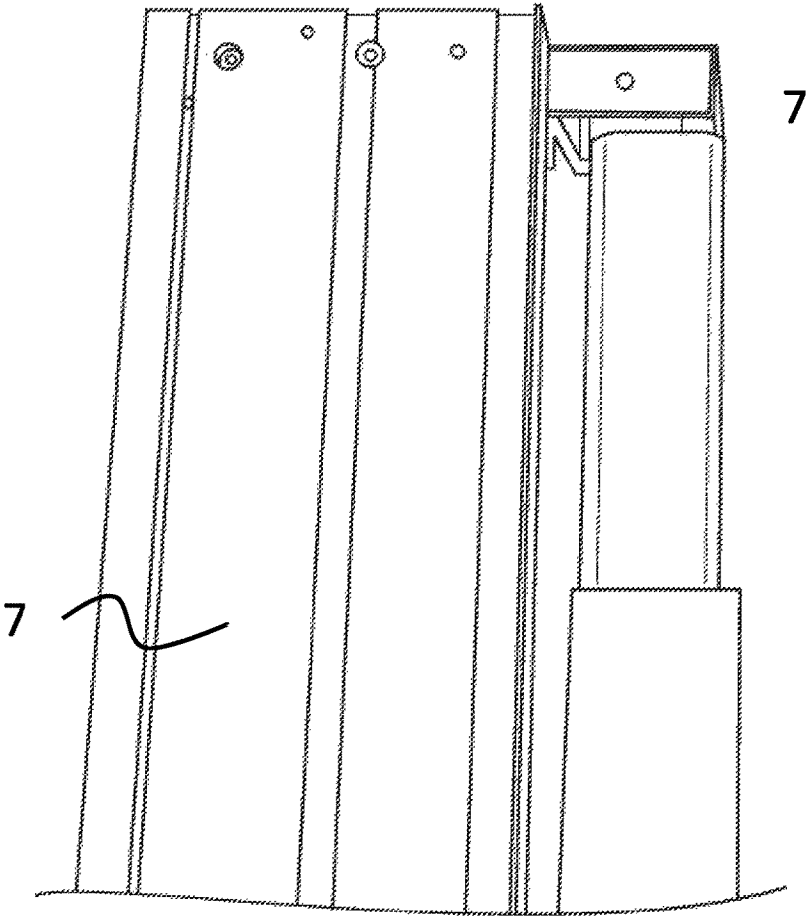
FIG. 3 is a top view of the frame of FIG. 1 illustrating a method of cutting into the conventional door frame of FIG. 1.
Figure 6:
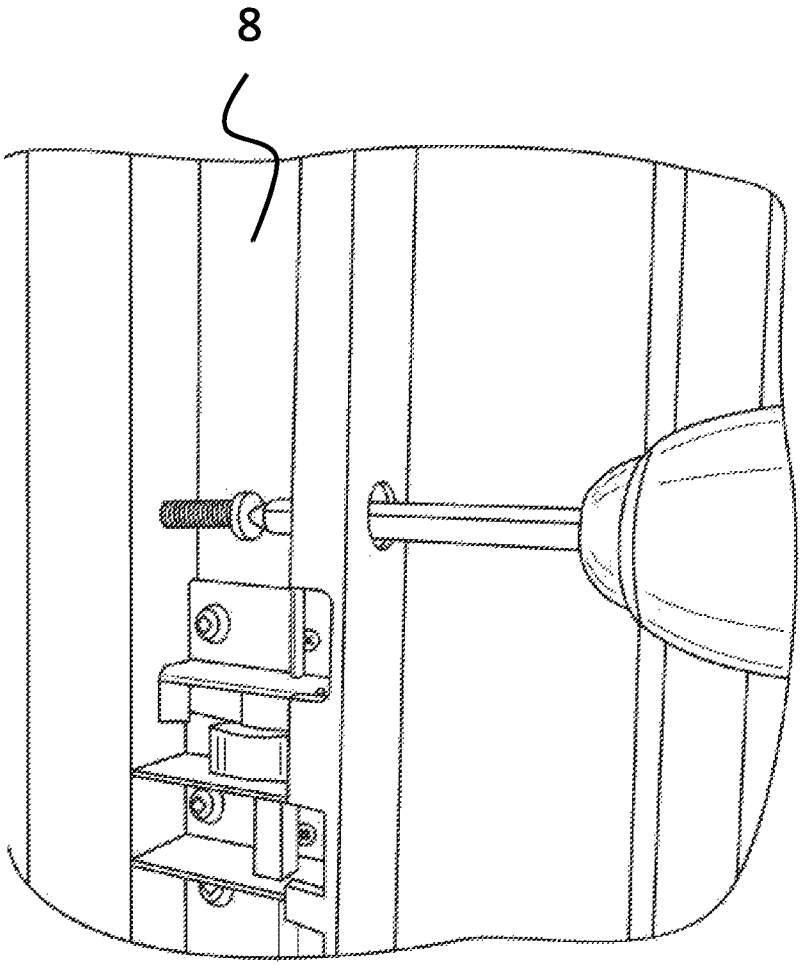
FIG. 6 is a detailed view showing a manner of installing the subframe on the conventional frame after it has been cut.
Figure 5:
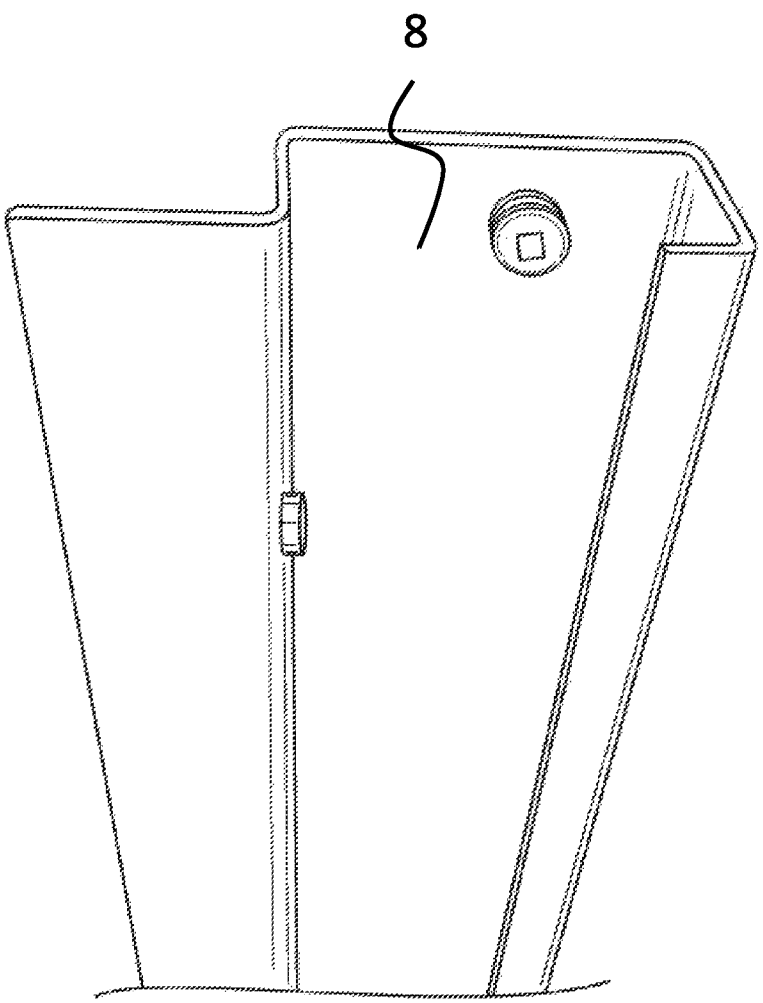
FIG. 5 is a detailed view of the subframe of FIG. 4.

FIG. 3 is a top view of the door frame of FIG. 1 illustrating a method of cutting into the conventional door frame of FIG. 1. FIG. 4 is a perspective view of a subframe according to an embodiment, mounted on the door frame of FIG. 1 after the conventional door frame has been cut. FIG. 5 is a detailed view of the subframe of FIG. 4. The profile of a subframe 8 is for illustration purposes and does not limit the present disclosure. FIG. 6 is a detailed view showing a manner of installing the subframe 8 on the conventional door frame after it has been cut. With the door dismounted from the frame, a cutaway section of the door frame 7 is removed and replaced with a subframe 8 that will receive the present multipoint door locking system. In most cases, the original door frame 7 can be cut and the subframe 8 can be installed on the remaining parts of the door frame 7 using ordinary tools. Alternatively, the complete frame of FIGS. 1 and 2 could be replaced with a complete new door frame 7 including the elements of the subframe 8. The cutaway section of the door frame 7 in the particular example shown on FIG. 3 extends to the top and bottom of this door frame 7. Likewise, the subframe 8 of FIG. 4 extends to the top and bottom of the door frame 7. In a variant, the cutaway section of the door frame 7 and the subframe 8 may extend along less than a full height of the door frame so it becomes easier to cut the top and/or the bottom of the door frame 7 when it is desired to mount the door frame and the door in an opening that may be somewhat smaller than a typical door opening height.

Figure 7:
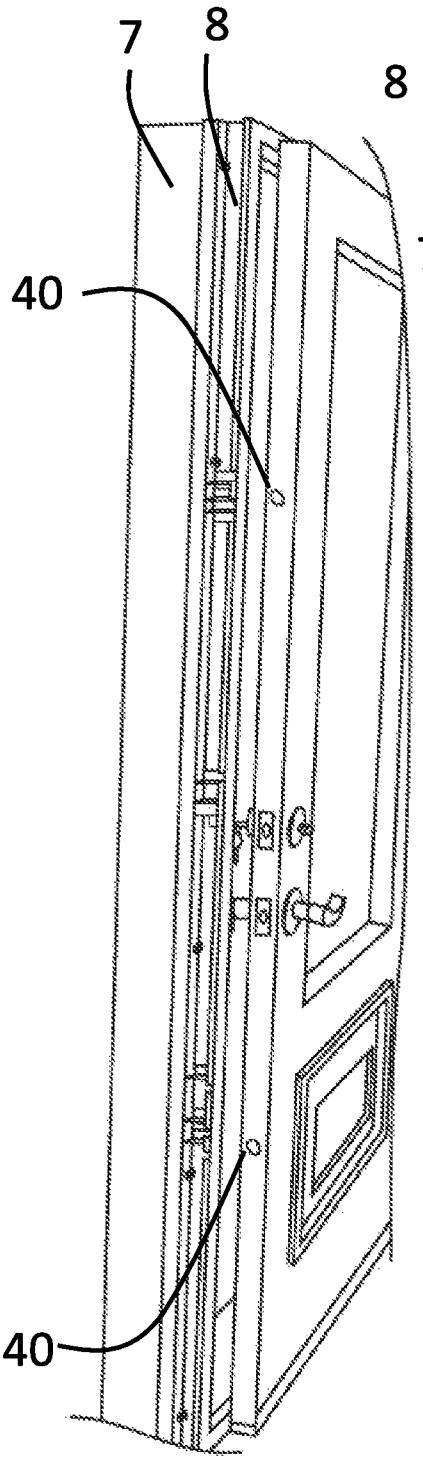
FIG. 7 is a perspective view of a multipoint door locking system according to an embodiment.
Figure 8:
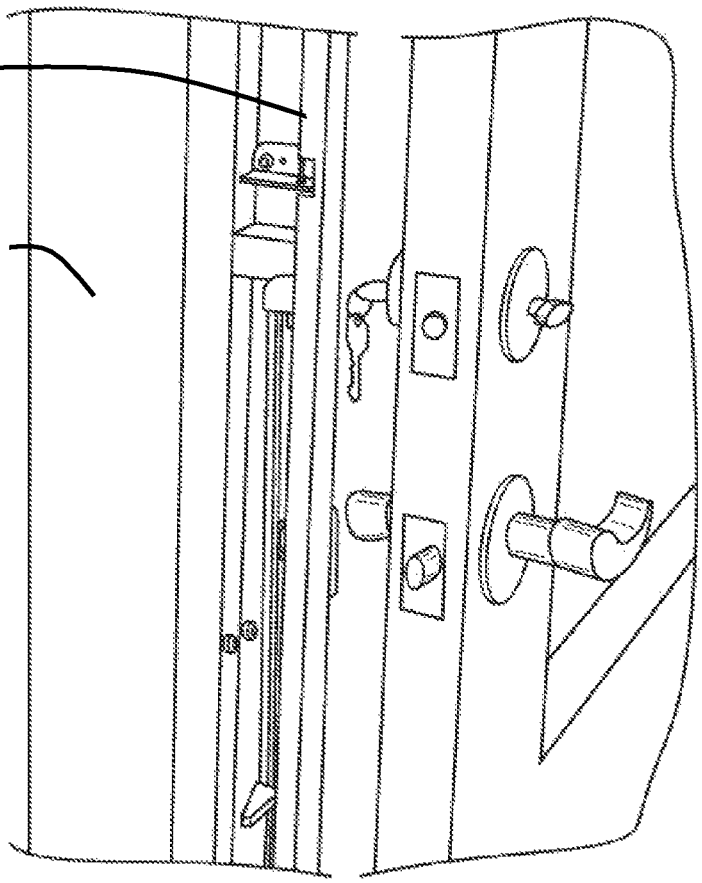
FIG. 8 is a detailed view of the multipoint door locking system of FIG. 7.
Figure 9:
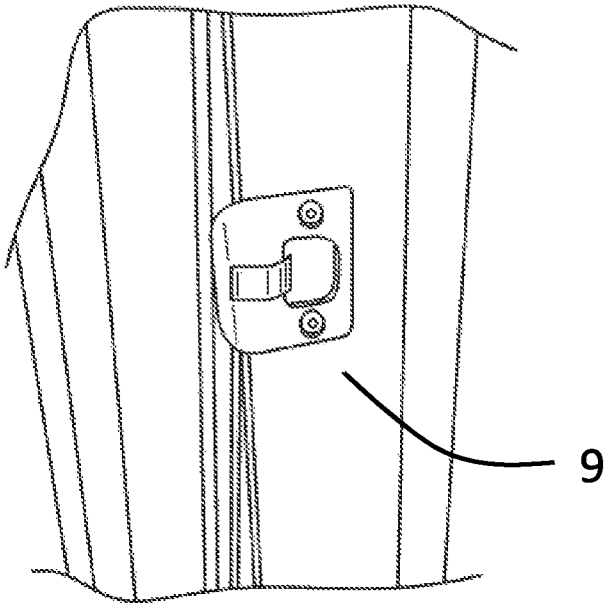
FIG. 9 is a detailed view of a striking plate mounted on a strike jamb of the door locking system of FIG. 7.

FIG. 7 is a perspective view of a multipoint door locking system according to an embodiment. FIG. 8 is a detailed view of the multipoint door locking system of FIG. 7. FIG. 9 is a detailed view of a doorknob latch mounted on a strike jamb of the door locking system of FIG. 7. A strike plate (not shown) may also be mounted on a strike jamb 9. As illustrated, the subframe 8 comprises a profile made of metal such as steel or aluminum. Provided that an internal face of the subframe 8 is painted or covered with a plastic finish (not shown), the door and frame assembly will not be visually different from an ordinary door and frame assembly once installed. FIG. 7 illustrates an embodiment in which a deadbolt is complemented with two (2) additional latches. Variants in which one, two, or more pivotable latches are implemented in the multipoint door locking system are also contemplated.

Figure 10:
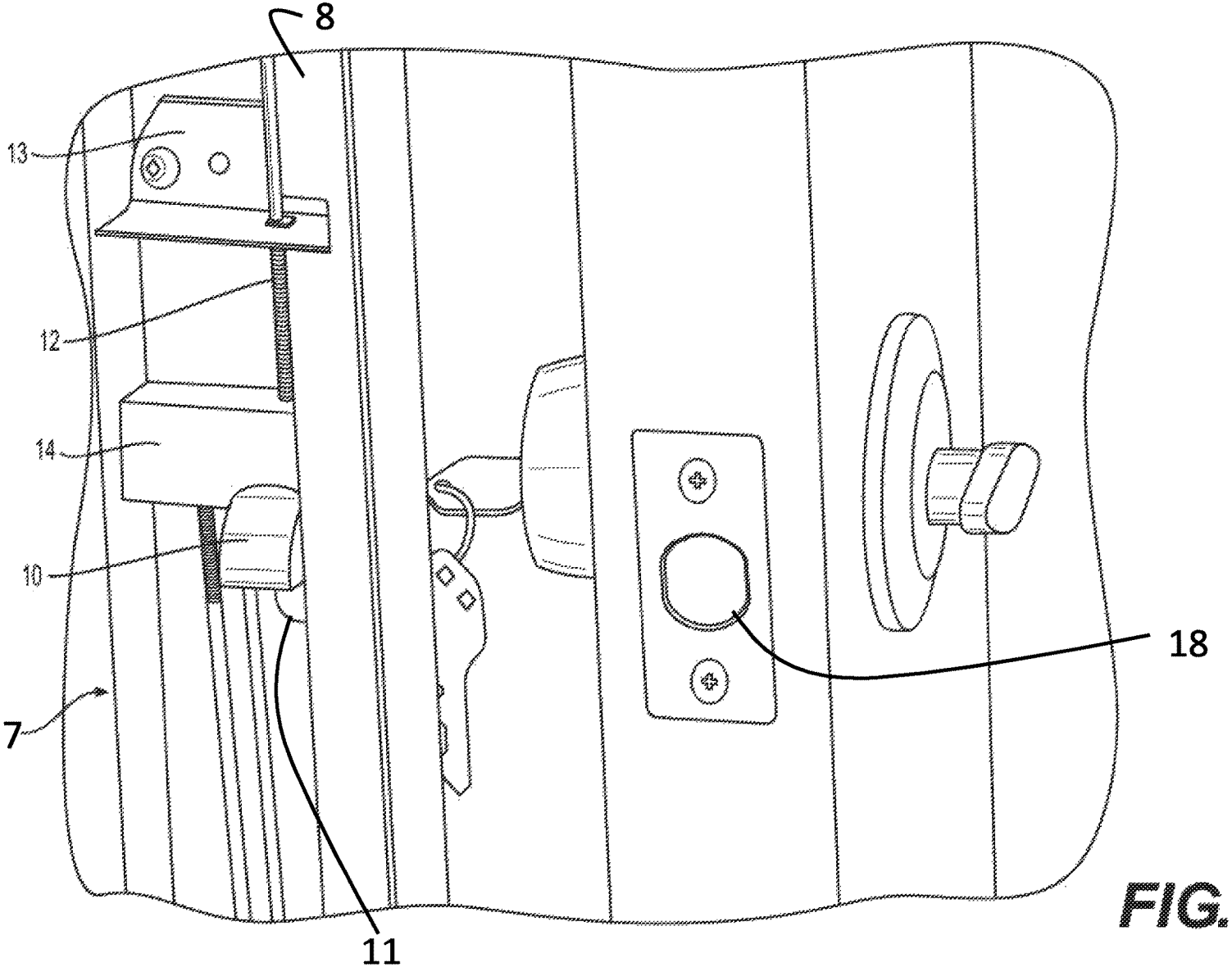
FIG. 10 is a detailed view of the multipoint door locking system of FIG. 7, showing a lever mounted in the subframe and in a resting position, with an open door.
Figure 11:
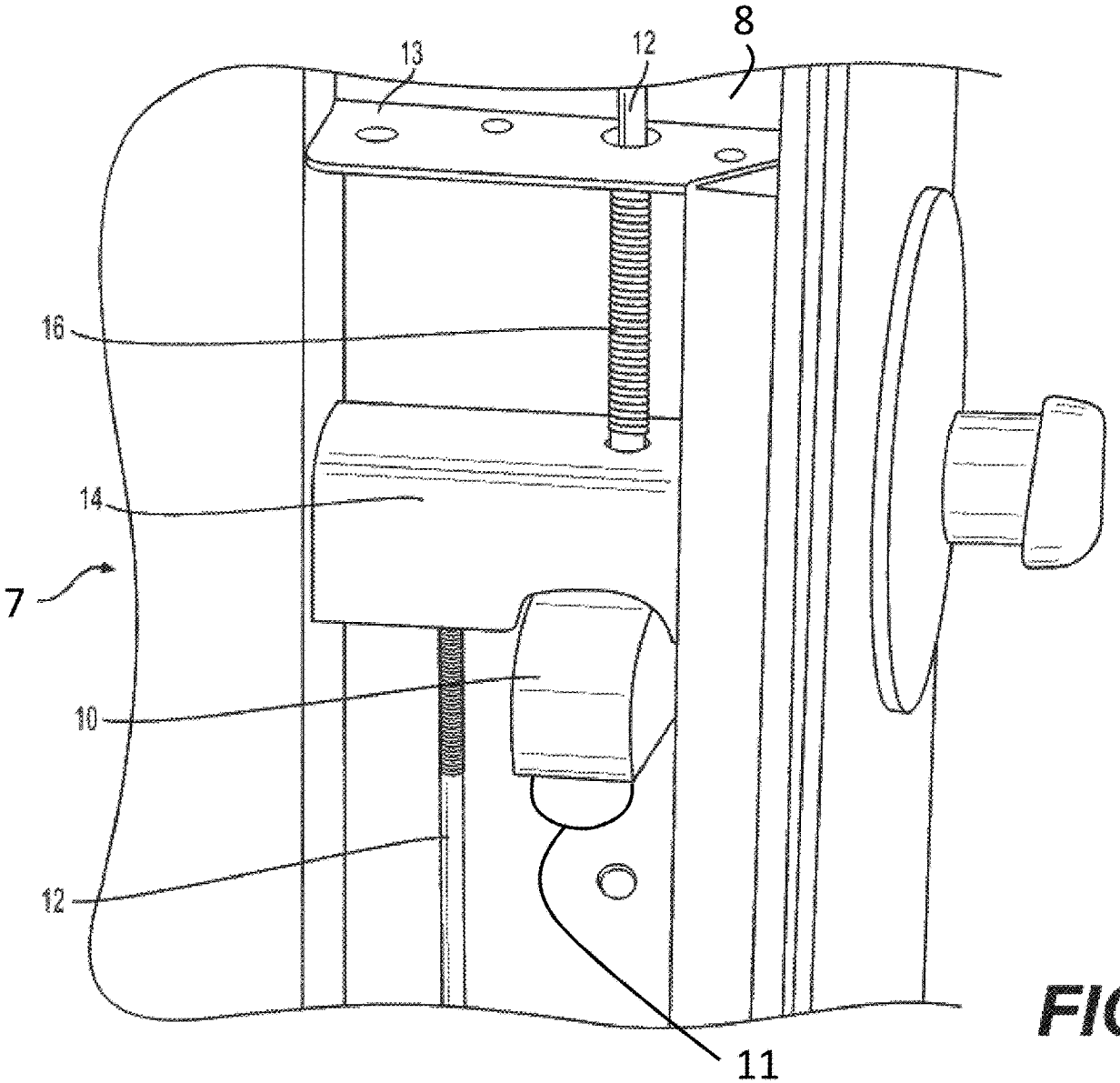
FIG. 11 is a detailed view of the multipoint door locking system of FIG. 7, showing the lever in a resting position, the door now being closed.
Figure 12:
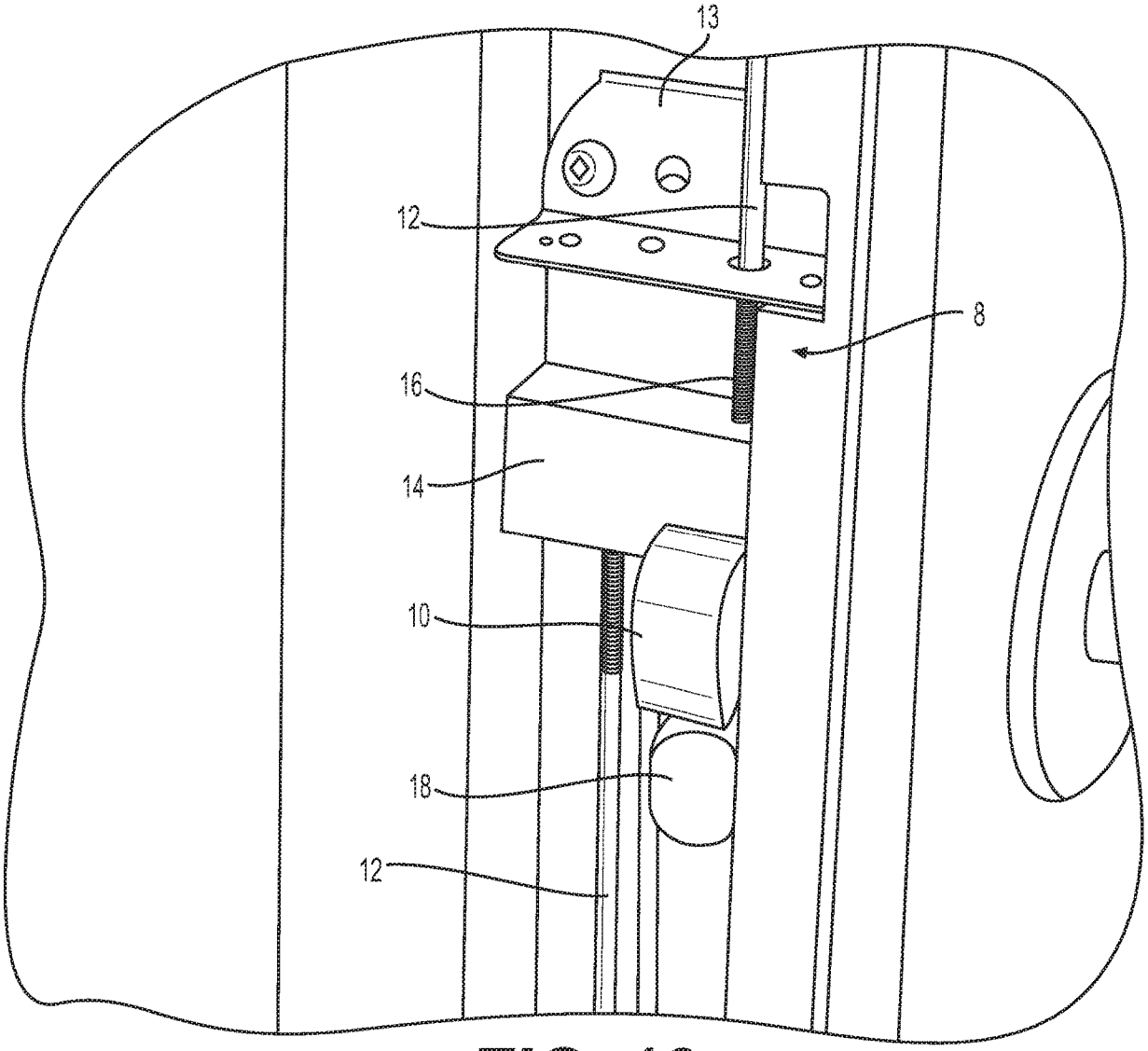
FIG. 12 is a detailed view of the multipoint door locking system of FIG. 7, showing a deadbolt inserted in a bolt opening and the lever in a locking position.

FIG. 10 is a detailed view of the multipoint door locking system of FIG. 7, showing a lever mounted in the subframe and in a resting position, with an open door. FIG. 11 is a detailed view of the multipoint door locking system of FIG. 7, showing the lever in a resting position, the door now being closed. FIG. 12 is a detailed view of the multipoint door locking system of FIG. 7, showing a deadbolt inserted in a bolt opening and the lever in a locking position. A bolt opening 11 is visible on FIG. 10. A lever 10 mounted in a subframe 8 connects to a translating member 12 (proximal ends of two translating members 12 are shown) via an interface block 14. The translating members 12 are held by use of guide plates 13. The lever 10 and the interface block 14 as shown are made of Teflon™, a polymer, or another plastic material. When the deadbolt 18 is not in the bolt opening 11, the lever 10 is in a resting position and the translating members 12 are in retracted positions (FIG. 11). When the deadbolt 18 is in the bolt opening 11, the lever 10 is in a locked position adjacent to the resting position and displaces the interface block 14 that, in turn, brings the translating members 12 in extended positions, compressing biasing elements such as a coil spring 16 mounted on the translating members 12.

Figure 13:
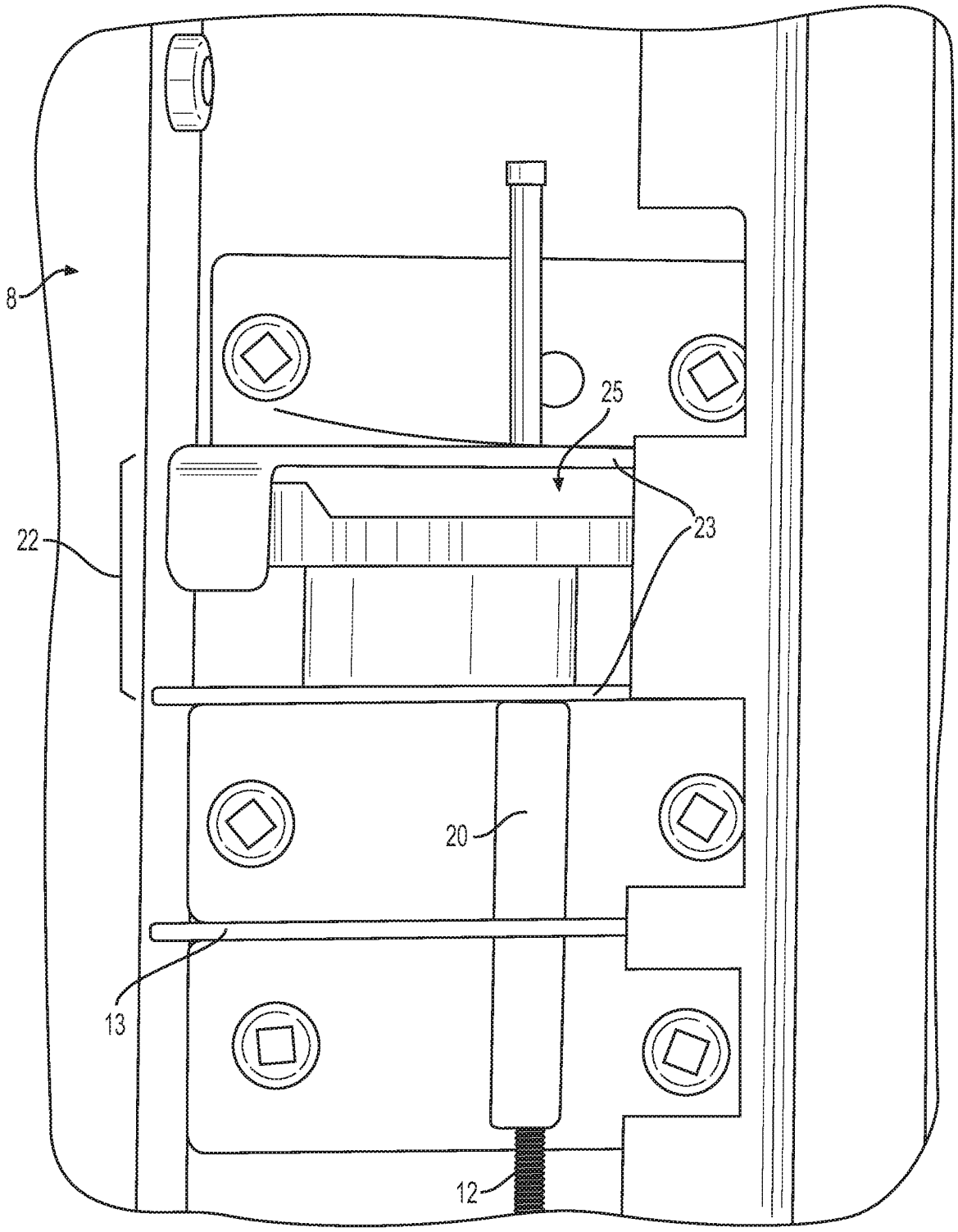
FIG. 13 is a detailed view of the multipoint door locking system of FIG. 7, showing a distal end of a translating member in a retracted position.
Figure 14:
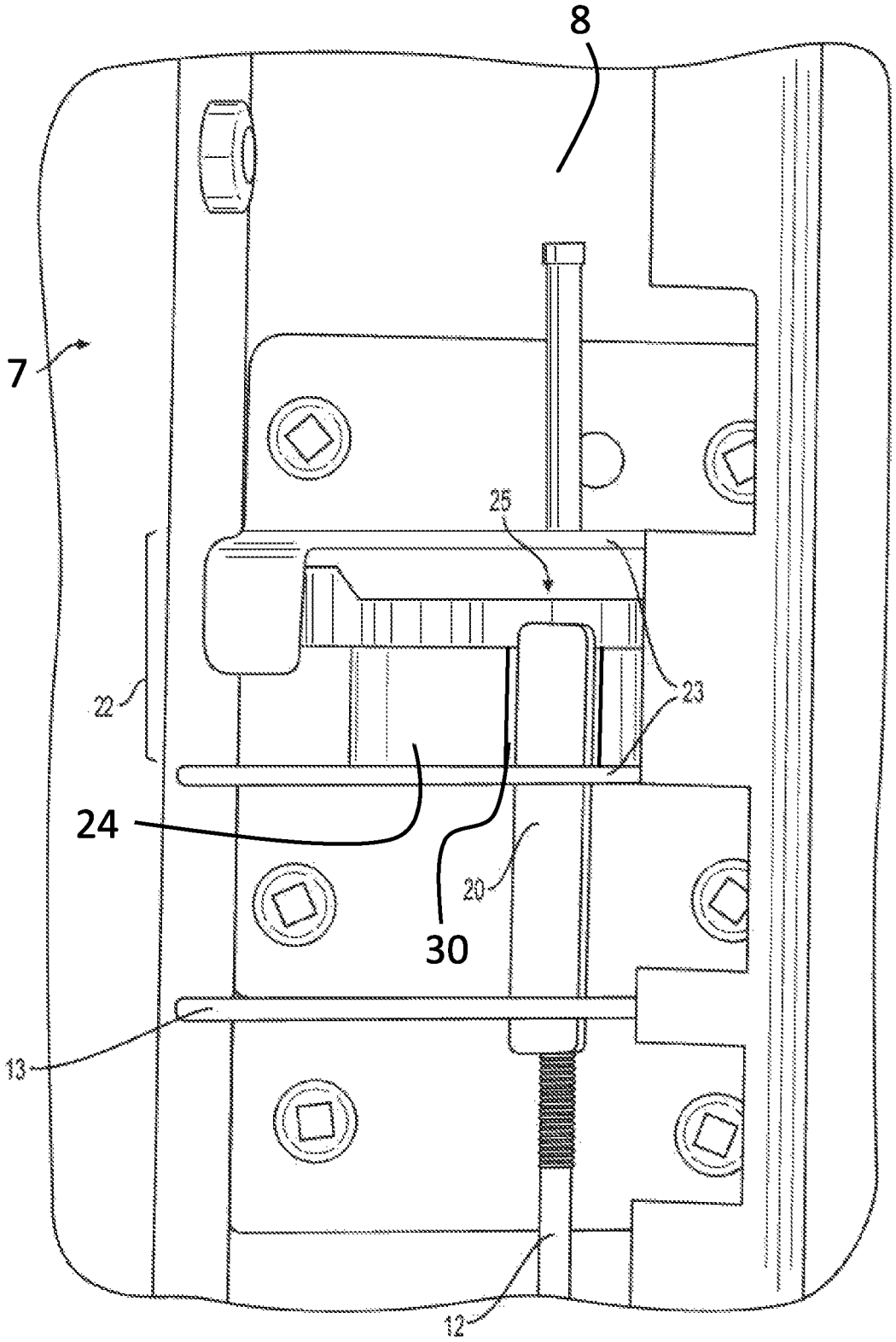
FIG. 14 is a detailed view of the multipoint door locking system of FIG. 7, showing the distal end of the translating member in an extended position.

FIG. 13 is a detailed view of the multipoint door locking system of FIG. 7, showing a distal end of a translating member in a retracted position. FIG. 14 is a detailed view of the multipoint door locking system of FIG. 7, showing the distal end of the translating member in an extended position. FIGS. 13 and 14 show a distal end of one of the translating members, respectively reaching (FIG. 14) and not reaching (FIG. 13) into a secondary opening 22 on the strike jamb 9 of the subframe 8. Pivotable latches are not shown on FIGS. 13 and 14 but are shown in the following Figures. A leaf spring 25 is also shown on FIGS. 13 and 14.

Figure 16:
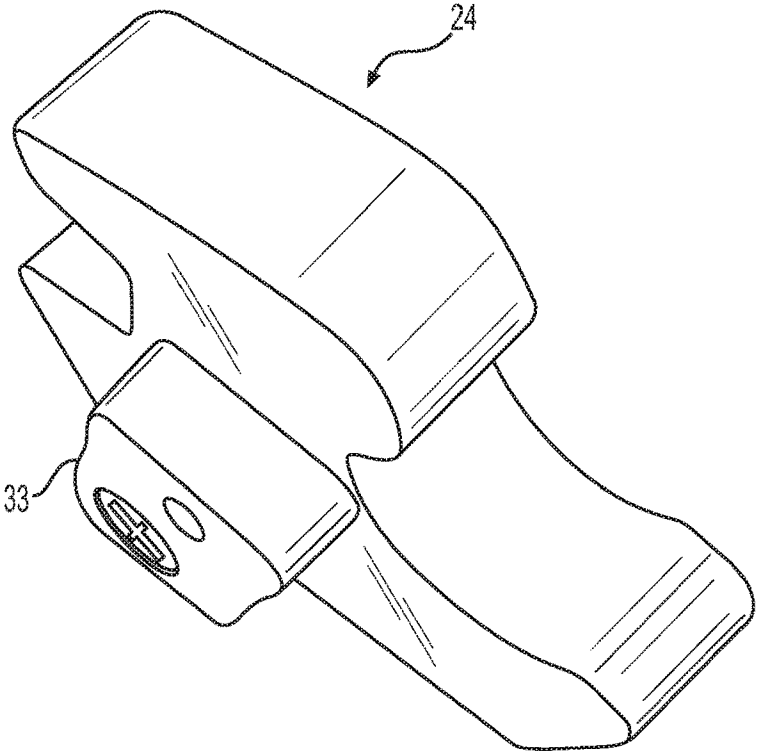
FIG. 16 is a perspective view of the pivotable latch of FIG. 15.
Figure 15:
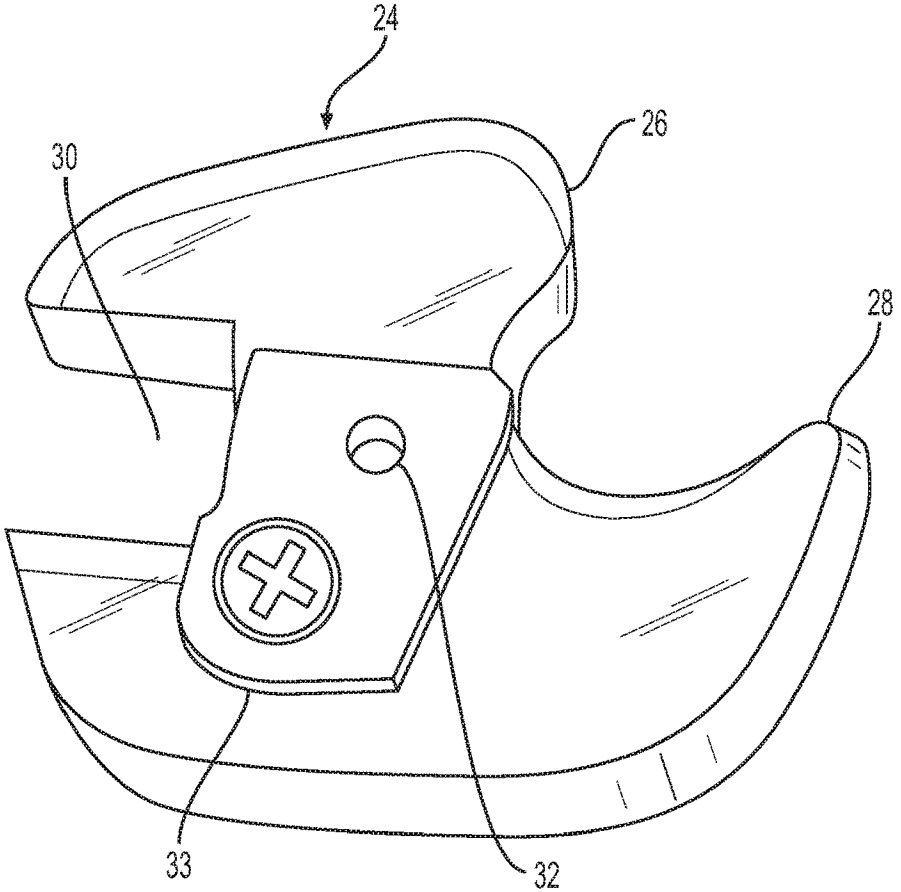
FIG. 15 is a top view of a pivotable latch.

FIG. 15 is a top view of a pivotable latch. FIG. 16 is a perspective view of the pivotable latch of FIG. 15. A pivotable latch 24 has a door-actuated tip 26 that is activable to rotate the pivotable latch 24 by closing action of the door, a door-locking tip 28 and a locking recess 30. The pivotable latch 24 also has an opening 32 for mounting the in the subframe 8 in a pivoting fashion. A stopper 33 is also mounted on the pivotable latch 24.

Figure 18:
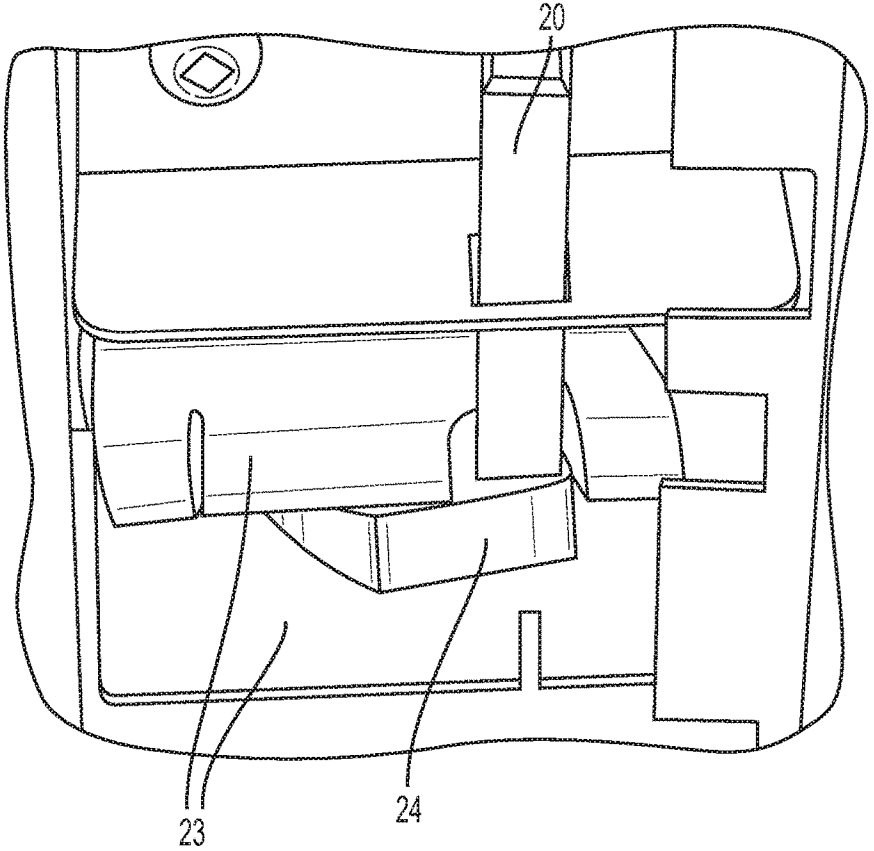
FIG. 18 is a close-up view of the interaction of the distal end of the translating member and of the pivotable latch when the system is unlocked.
Figure 17:
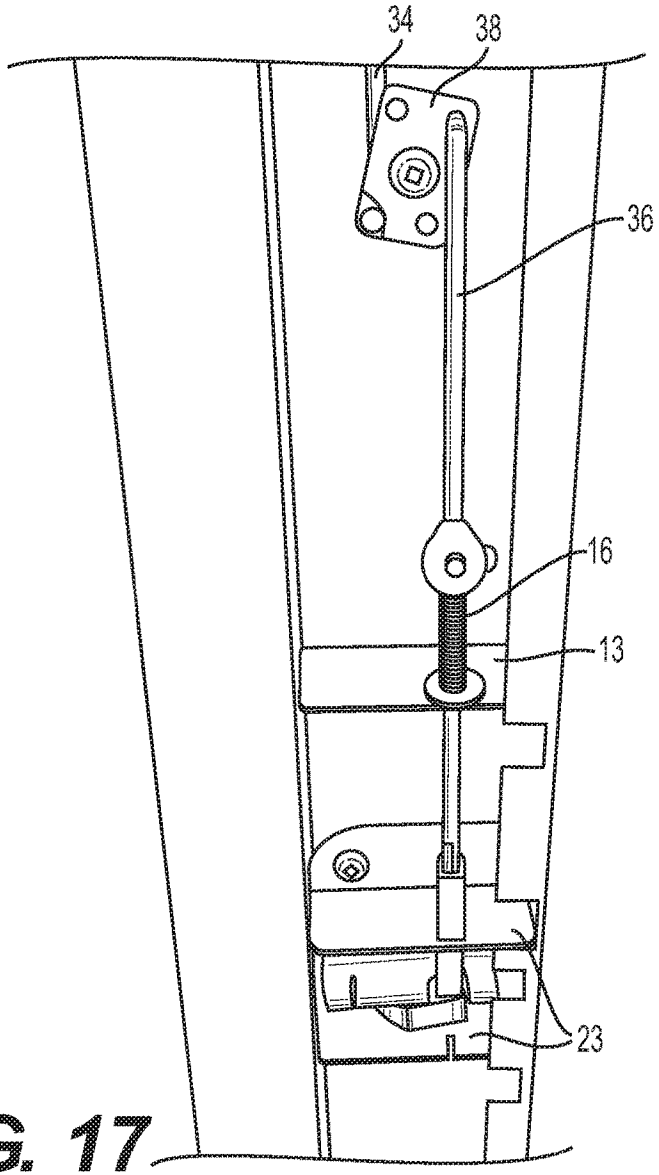
FIG. 17 is a general view showing the interaction of the distal end of the translating member and of the pivotable latch when the system is unlocked.
Figure 20:
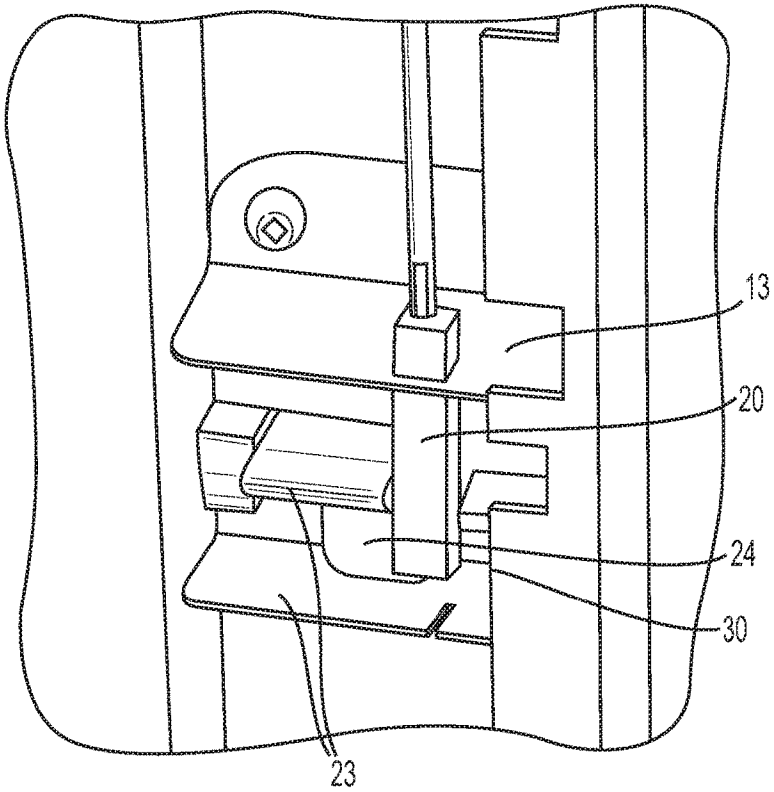
FIG. 20 is a close-up view of the interaction of the distal end of the translating member and of the pivotable latch when the system is locked.
Figure 19:
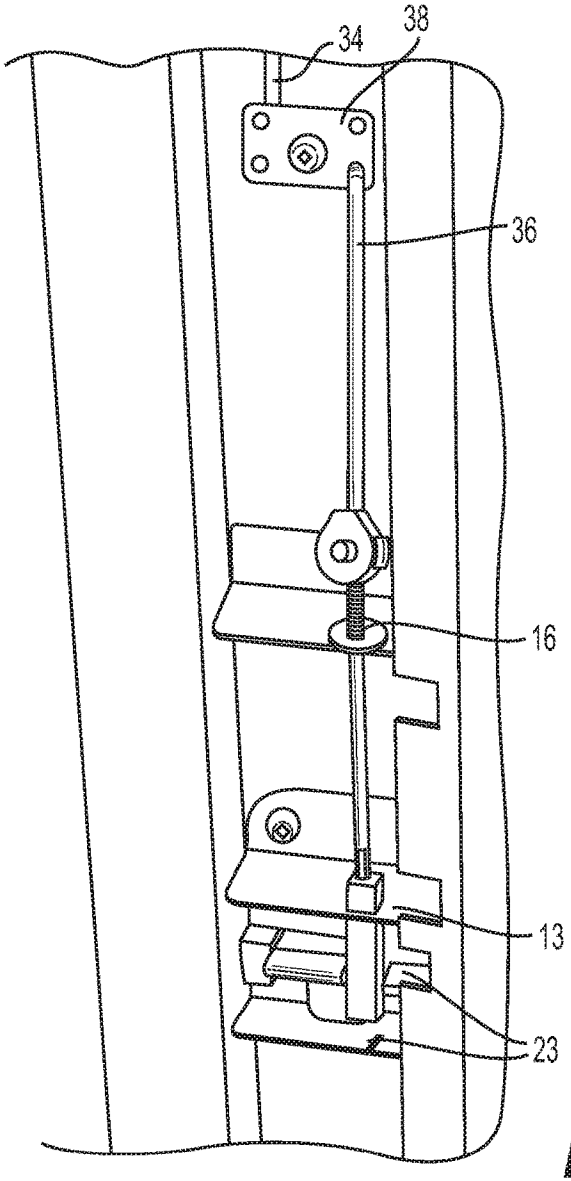
FIG. 19 is a general view showing the interaction of the distal end of the translating member and of the pivotable latch when the system is locked.

FIG. 17 is a general view showing the interaction of the distal end of the translating member and of the pivotable latch when the system is unlocked. FIG. 18 is a close-up view of the interaction of the distal end of the translating member and of the pivotable latch when the system is unlocked. FIG. 19 is a general view showing the interaction of the distal end of the translating member and of the pivotable latch when the system is locked. FIG. 20 is a close-up view of the interaction of the distal end of the translating member and of the pivotable latch when the system is locked. In FIGS. 17-20, the translating member 12 is split into a top section 34, which extends from the interface block 14 of earlier Figures, and a bottom section 36, the top and bottom sections 34 and 36 being linked by a pivoting plate 38. When the interface block 14 is pushed upwards by the lever 10, the top section 34 is pulled upwards, the pivoting plate 38 rotates and the bottom section 36 is pushed downward. As shown on FIGS. 17 and 18, when the bottom section 36 is in its raised position (the translating member 12 formed by the sections 34 and 36 being in the retracted position), a distal end 20 of the translating member 12 does not reach the pivotable latch 24, which is supported by support plates 23. As shown on FIGS. 19 and 20, when the bottom section 38 is in its lowered position (the translating member 12 formed by the sections 34 and 36 being in the extended position), the distal end 20 reaches into the locking recess 30 of the pivotable latch 24, which is thus locked. The locking recess 30 as shown is an indentation adapted to receive the distal end 20, but it could also be an aperture adapted to receive the distal end 20. FIGS. 17 and 19 also show a coil spring 16 mounted on the section 36 of the translating member 12. The coil spring 16 is compressed when the translating member 12 is in the extended position. When the deadbolt 18 is removed from the bolt opening 11, a force exerted by the compressed coil spring 16 causes the translating member 12 to return to its retracted position, causing the interface block 14 to push down on the lever 10 that then returns to the resting position as shown on FIG. 11. In a variant without the presence of the coil springs 16 on the translating members 12, the lever 10 returns to the resting position by gravity, followed by the interface block 14.

Figure 21:
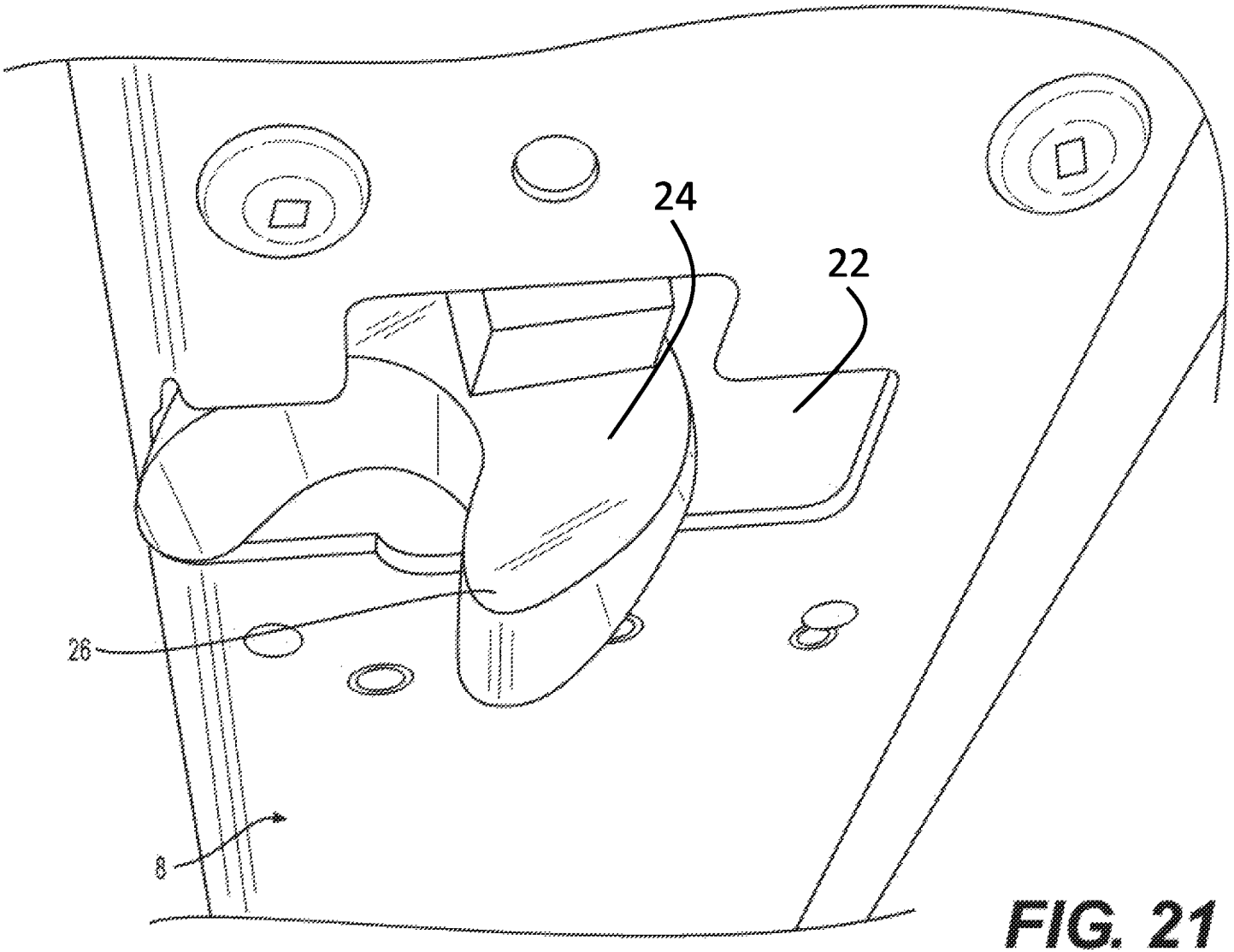
FIG. 21 is a detailed view of a door-actuated tip of the pivotable latch protruding through a secondary opening of the door frame.
Figure 22:
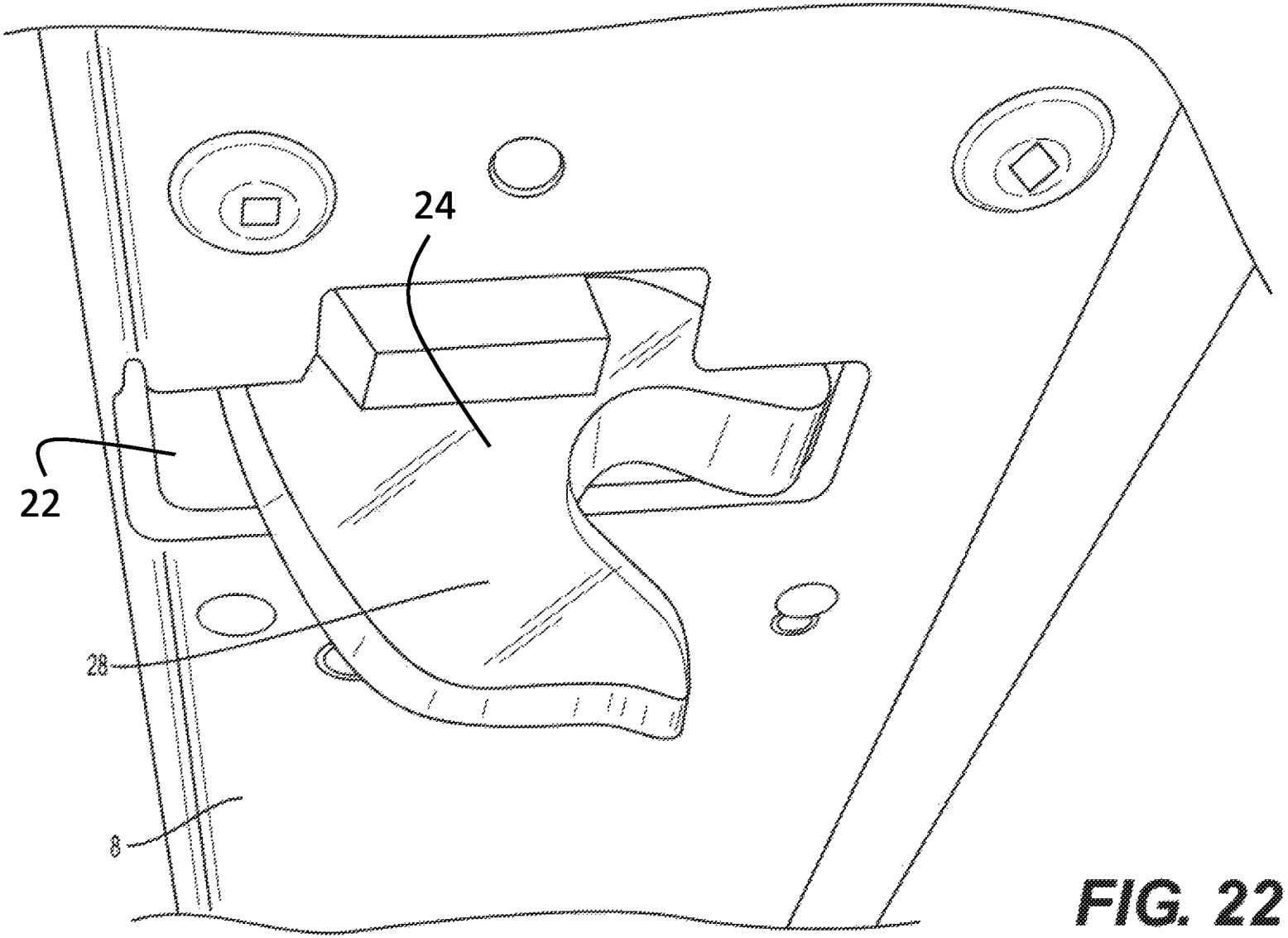
FIG. 22 is a detailed view of a door-locking tip of the pivotable latch protruding through a secondary opening of the door frame.

FIG. 21 is a detailed view of a door-actuated tip of the pivotable latch protruding through a secondary opening of the door frame. FIG. 22 is a detailed view of a door-locking tip of the pivotable latch protruding through a secondary opening of the door frame. These Figures show how the tips of the pivotable latch 24 may be visible from the strike jamb 9 of the subframe 8. It may however be noted that, under normal operation, the door-locking tip of the pivotable latch 24 would not be visible as shown on FIG. 22 since it is intended to protrude from the door frame 7 and into a secondary bore 40 (FIGS. 7 and 23) of the door when the door is closed, thereby being in the pre-armed position of the multipoint door locking system.

In some embodiments, the stopper 33 of the pivotable latch 24 interfaces with the leaf spring 25 shown on FIGS. 13 and 14. As the pivotable latch 24 rotates, the stopper 33 compresses the leaf spring 25. The resulting compression of the leaf spring 25 by the stopper 33 causes the pivotable latch 24 to rapidly move between two (2) stable positions in which either one of the door-actuated tip 26 or the door-locking tip 28 protrudes from subframe 8. This effect of the leaf spring 25 on the pivotable latch 24 facilitates the opening and closing of the door while preventing, in these embodiments, free movement of the pivotable latch 24.

Figure 23:
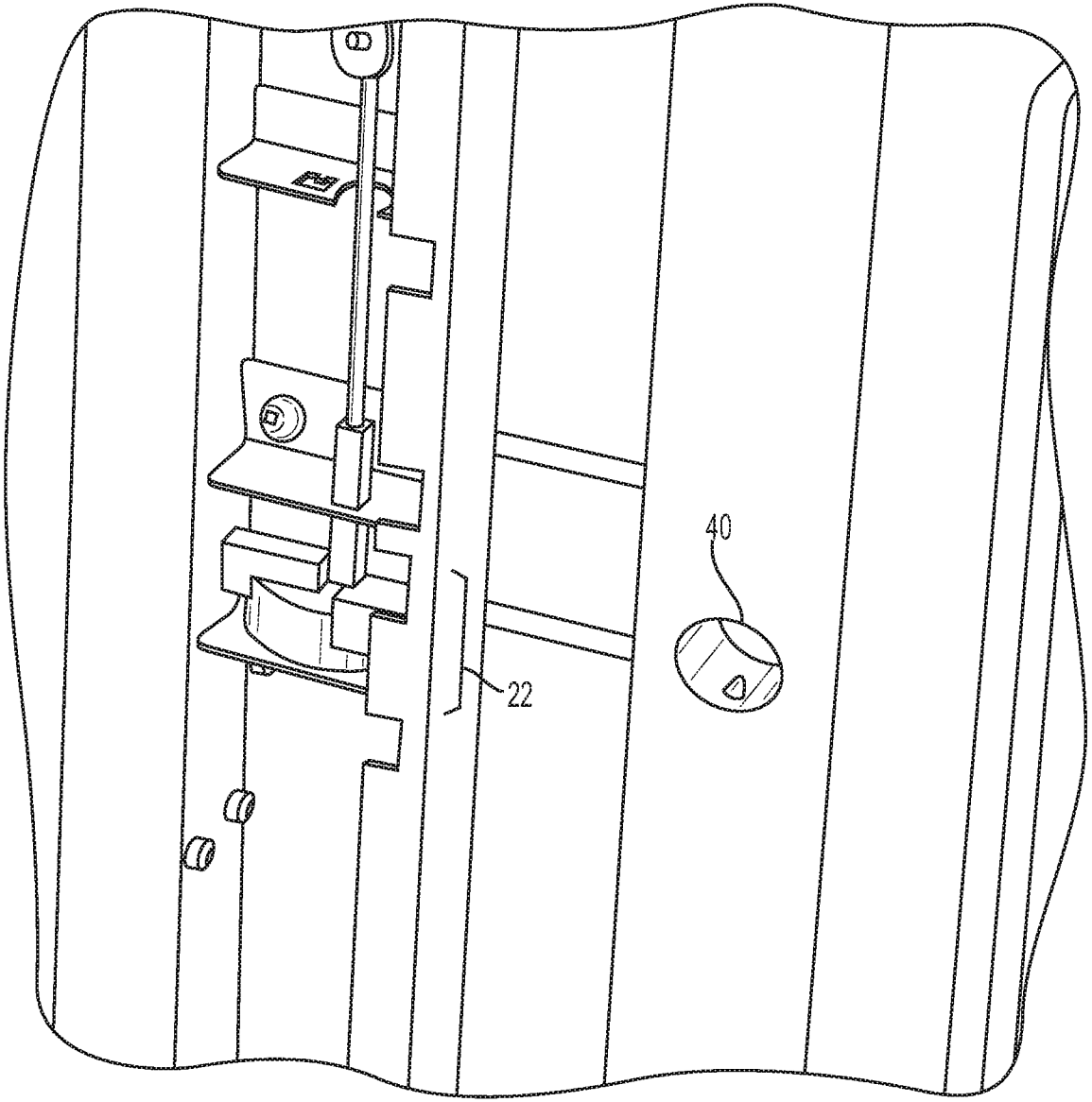
FIG. 23 is a detailed view of a secondary bore on the edge of the door of FIG. 7, vertically aligned with the secondary opening of FIGS. 21 and 22.

FIG. 23 is a detailed view of a secondary bore on the edge of the door of FIG. 7, vertically aligned with the secondary opening of FIGS. 21 and 22. A secondary bore 40 cut into the door will be aligned with the secondary opening 22 when the door is closed so that the door-locking tip 28 can enter the secondary bore 40.

Figure 24:
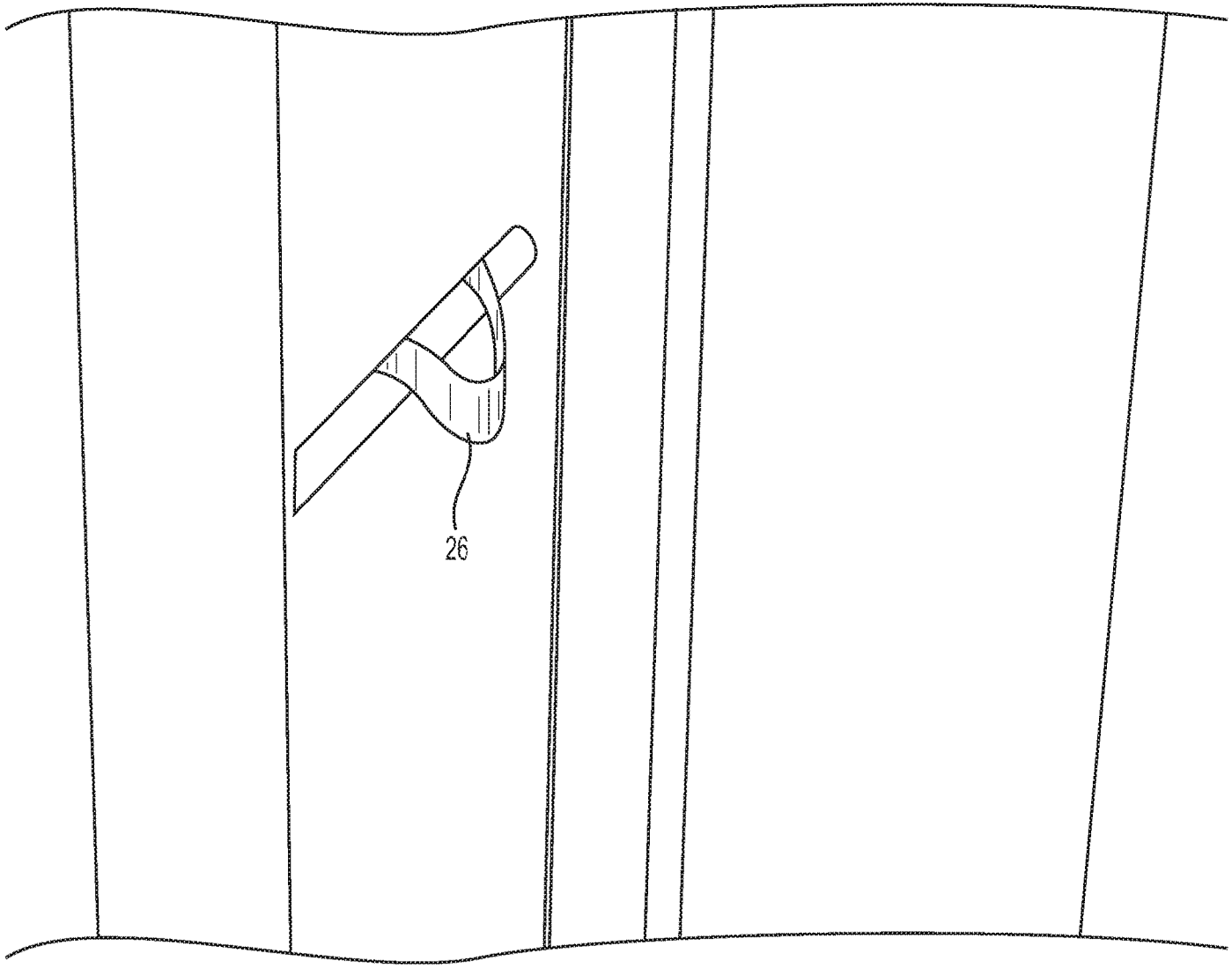
FIG. 24 is a detailed view of the door-actuated tip of the pivotable latch protruding through a protective metal or plastic cover of the subframe.

FIG. 24 is a detailed view of the door-actuated tip of the pivotable latch protruding through a protective metal or plastic cover of the subframe and waiting to be activated, or pushed, by the closing movement of the door within its door frame.

Figure 25:
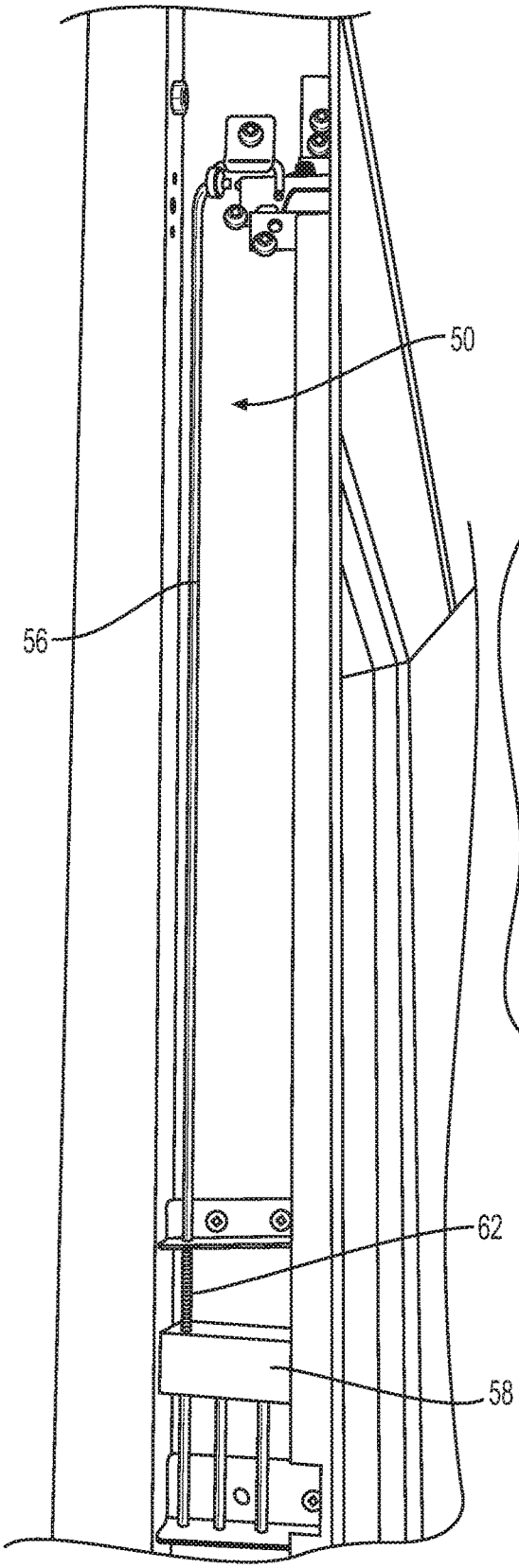
FIG. 25 is a general view of a safety device added to the multipoint door locking system of FIG. 7.
Figure 26:
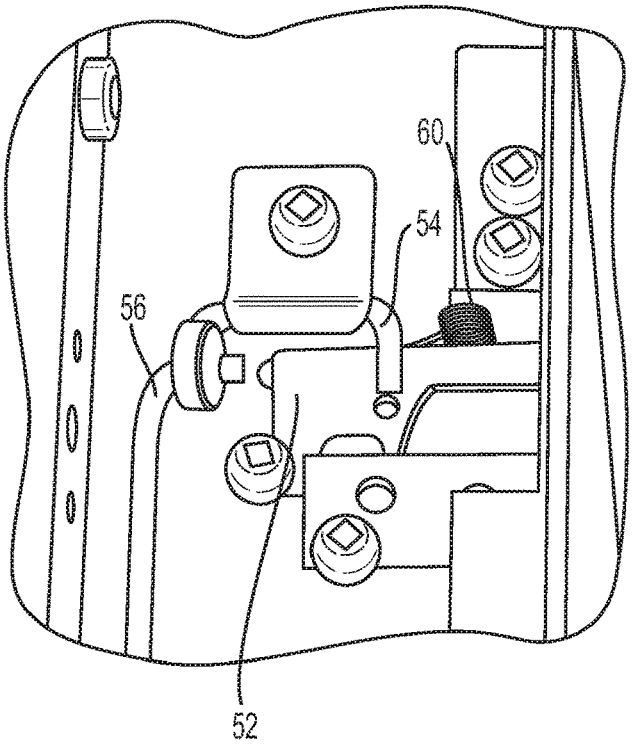
FIG. 26 is a detailed view of the safety device of FIG. 25.
Figure 27:
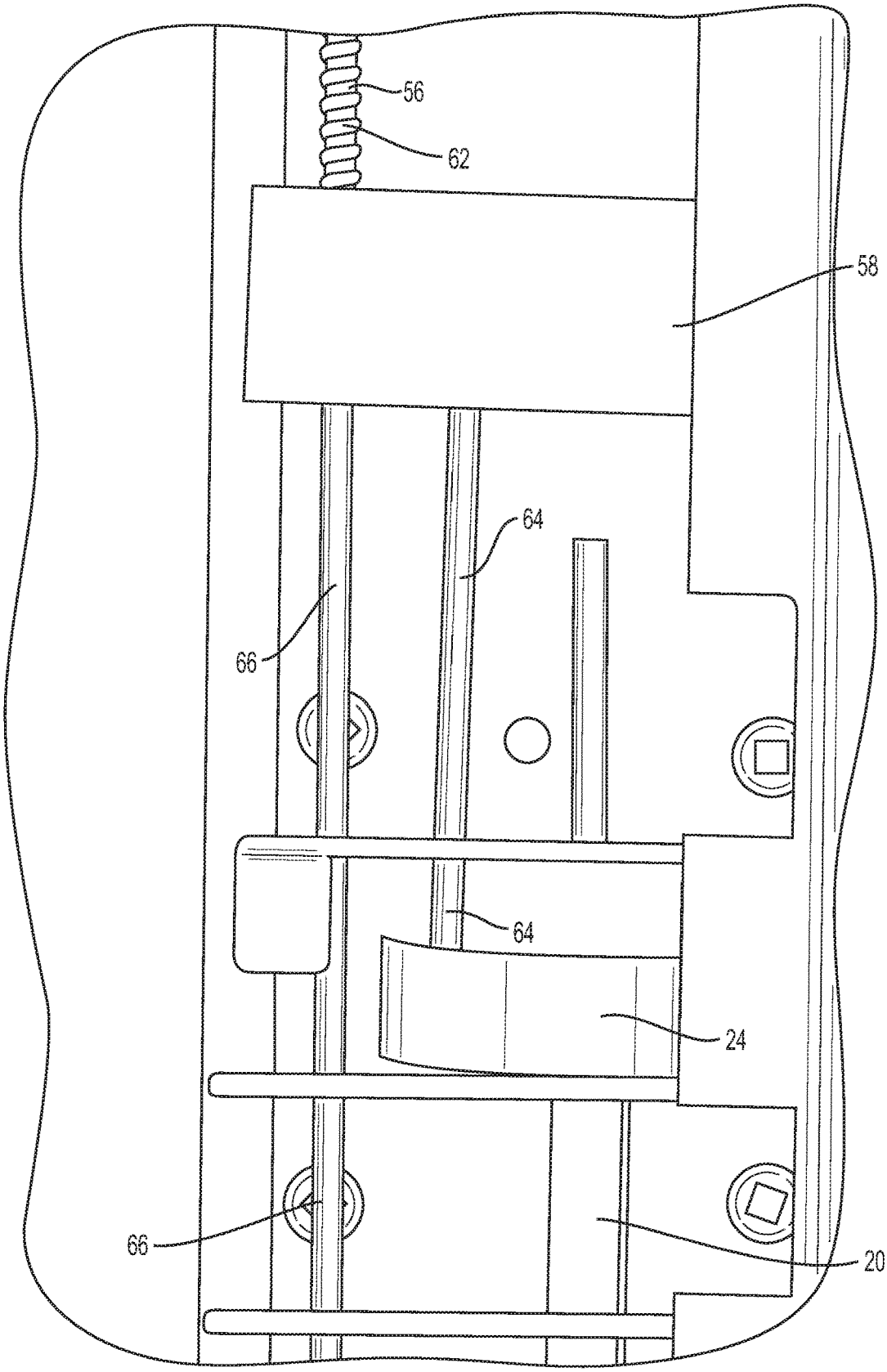
FIG. 27 is another detailed view of the safety device of FIG. 25.

In the multipoint door locking system as shown in the previous drawings, nothing prevents accidentally moving the pivotable latch 24 so that the door-locking tip 28 protrudes from the subframe 8 when the door is open. In a situation where, for instance, a child would play with the pivotable latch 24 and place it in the incorrect position, the edge of the door could hit the door-locking tip 28 upon closing, potentially damaging the door or the multipoint door locking system. The following drawings illustrate a safety device that may optionally be added to the multipoint door locking device. In more details, FIG. 25 is a general view of a safety device added to the multipoint door locking system of FIG. 7, FIG. 26 is a detailed view of the safety device of FIG. 25, and FIG. 27 is another detailed view of the safety device of FIG. 25. As shown on FIGS. 25, 26 and 27, a safety device 50 includes a spring-loaded tab 52 that protrudes through yet another opening (not shown) on the strike jamb 9 of the subframe 8. When the door is closed in the subframe 8, the tab 52 pushes on a U-shaped lever 54 connected to a rod 56 so that the rod 56 is raised. Raising the rod 56 in turns lifts a plastic block 58. A coil spring 60 attached to the tab 52 or another coil spring 62 mounted on the rod 56, or both coil springs 60 and 62 acting in combination, provide that the rod 56 is automatically lowered and that the tab 52 automatically protrudes through the subframe 8 when the door is open. Two locking rods 64 and 66 are attached to the block 58 and entrained by the movement of the block 58. Considering FIG. 27 showing the block 58 in the lowered position (the door is open, the tab 52 is not pushed and the rod 56 is lowered), a tip of the locking rod 64 enters in the locking recess 30 of the pivotable latch 24 while, at the same time, the translating member 12 is in the retracted position and its distal end 20 does not lock the pivotable latch 24. Presence of the tip of the locking rod 64 within the locking recess 30 prevents accidentally rotating the pivotable latch 24. The locking rod 66 extends toward the bottom of the multipoint door locking system and likewise engages the other pivotable latch 24.

Upon closing the door, the edge of the door at first causes the tab 52 to be pushed into the subframe 8, rotating the U-shaped lever 54, raising the rod 56 and the block 58, and bringing the tips of the locking rods 64 and 66 out of the locking recesses 30 of the pivotable latches 24. Thereafter, the edge of the door pushes on the pivotable latches 24 as explained hereinabove. When the door is opened again, it first causes the pivotable latches 24 to rotate so that their door-actuated tips 26 protrude again. The door then stops pushing on the tab 52, causing the rod 56, the block 58 and the locking rods 64 and 66 to be lowered, blocking the pivotable latches 24 again.

In variants in which one or more additional latches are implemented in the multipoint door locking system, it is contemplated that the safety device 50 may include a corresponding locking rod for each latch. In a specific variant having one pivotable latch 24, the block 58 may be omitted, the rod 56 and the locking rod 64 being optionally combined as a single element for blocking the pivotable latch 24. The safety device 50 can be used in combination with all variants of the multipoint door locking device Those of ordinary skill in the art will realize that the description of the multipoint door locking system is illustrative only and is not intended to be in any way limiting. Other embodiments will readily suggest themselves to such persons with ordinary skill in the art having the benefit of the present disclosure. Furthermore, the disclosed multipoint door locking system may be customized to offer valuable solutions to existing deficiencies of conventional multipoint door locks.

In the interest of clarity, not all of the routine features of the implementations of the multipoint door locking system are shown and described. It will, of course, be appreciated that in the development of any such actual implementation of the multipoint door locking system, numerous implementation-specific decisions may need to be made in order to achieve the developer's specific goals, such as compliance with application-, system-, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of door locks having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. A multipoint door lock system for a door having on its edge a deadbolt and a secondary bore separated from the deadbolt, comprising:

a door frame comprising a subframe, the subframe having a strike jamb, a bolt opening provided in the strike jamb being adapted to receive the deadbolt, the strike jamb having a secondary opening positioned to face the secondary bore of the door when the door is closed in the door frame;

a pivotable latch having a locking recess, a door-actuated tip and a door-locking tip, the pivotable latch being mounted in the subframe so that the door-actuated tip can protrude through the secondary opening of the strike jamb as the pivotable latch rotates, the pivotable latch being configured to rotate when the edge of the door pushes the door-actuated tip into the subframe, causing the door-locking tip to enter in the secondary bore of the door;

a lever mounted in the subframe and movable between a resting position facing the bolt opening when the deadbolt is not inserted in the bolt opening and a locking position adjacent to the resting position when the deadbolt is inserted in the bolt opening; and a translating member having a proximal end operatively connected to the lever and a distal end extending toward the locking recess of the pivotable latch, the translating member taking a retracted position when the lever is in the resting position, leaving the distal end of the translating member outside the locking recess of the pivotable latch, the translating member taking an extended position when the lever is in the locking position, inserting the distal end of the translating member in the locking recess to lock the pivotable latch, whereby the pivotable latch is placed in a pre-armed position when the door-actuated tip enters the secondary bore of the door and when, concurrently, the distal end of the translating member is not inserted in the locking recess, the pivotable latch being placed in a locked position by the insertion of the distal end of the translating member in the locking recess.

2. The multipoint door lock system of claim 1, comprising:

two pivotable latches mounted in the subframe on opposite sides of the bolt opening and protruding through two respective secondary openings of the strike jamb; and two translating members having respective proximal ends operatively connected to the lever and respective distal ends extending toward respective ones of the two pivotable latches;

wherein door-locking tips of the two pivotable latches are configured to enter in two corresponding secondary bores of the door; and wherein insertion of the deadbolt in the bolt opening causes an insertion of the distal ends of the two translating members in locking recesses of the respective pivotable latches.

3. The multipoint door lock system of claim 1, wherein the translating member is operatively connected to the lever by an interface block.

4. The multipoint door lock system of claim 1, comprising a biasing element connected to the subframe and to the translating member, the biasing element causing the translating member to return to the retracted position when the deadbolt is removed from the bolt opening.

5. The multipoint door lock system of claim 1, comprising a safety device, the safety device including:

a tab protruding through a ternary opening of the strike jamb and configured to be pushed by the edge of the door when the door closes; and a rod operably connected to the tab and configured to move to a raised position when the tab is pushed by the door and to a lowered position when the tab is not pushed by the door, a tip of the rod being adapted to prevent rotating the pivotable latch when the rod is in the lowered position.

6. The multipoint door lock system of claim 1, wherein the translating member comprises two sections, a first section extending from the proximal section to a pivoting plate mounted to the subframe, a second section extending from the pivoting plate to the distal section, moving the first section in a first direction causing the pivoting plate to rotate and causing the second section to move in a second direction opposite from the first direction.

7. The multipoint door lock system of claim 1, comprising support plates integrated in the subframe and adapted to rotatably support the pivotable latch.

8. The multipoint door lock system of claim 1, wherein the distal end of the translating member has a square cross-section and wherein the locking recess of the pivotable latch has a shape matching the cross-section of the distal end of the translating member to prevent rotation of the pivotable latch when the distal end of the translating member is inserted in the locking recess.

9. The multipoint door lock system of claim 1, wherein the locking recess is a through-hole in the pivotable latch.

10. The multipoint door lock system of claim 1, wherein the locking recess is an indentation on a side of the pivotable latch.

11. The multipoint door lock system of claim 1, further comprising:

the door and the deadbolt.

12. A multipoint door lock system for a door having on its edge a deadbolt and a secondary bore separated from the deadbolt, comprising:

a door frame;

a pivotable latch mounted in the door frame, the pivotable latch having a locking recess, the pivotable latch further having a door-locking tip configured to enter the secondary bore of the door through a secondary opening of the door frame when the door is closed in the door frame;

a lever mounted in the door frame and configured to move from a resting position to a locking position upon insertion of the deadbolt in a bolt opening of the door frame; and a translating member mounted in the door frame having a proximal end operatively connected to the lever and a distal end opposite from the proximal end, the translating member being configured to move from a retracted position to an extended position when the lever is moved to the locking position upon insertion of the deadbolt in the bolt opening of the door frame, the distal end of the translating member entering the locking recess of the pivotable latch to lock the pivotable latch, preventing the door-locking tip from exiting the secondary bore of the door when the deadbolt is inserted in the bolt opening.

13. The multipoint door lock system of claim 12, comprising:

two pivotable latches mounted in the door frame on opposite sides of the bolt opening and protruding through two respective secondary openings of the door frame, each pivotable latch further having a locking recess; and two translating members having respective proximal ends operatively connected to the lever and respective distal ends extending toward respective ones of the two pivotable latches, each of the translating members being configured to move from respective retracted positions to respective extended positions when the lever is moved to the locking position upon insertion of the deadbolt in the bolt opening of the door frame;

wherein door-locking tips of the two pivotable latches are configured to enter in two corresponding secondary bores of the door; and wherein insertion of the deadbolt in the bolt opening causes the respective distal ends of the two translating members to enter the locking recesses of the respective pivotable latches to lock the respective pivotable latches.

14. The multipoint door lock system of claim 12, further comprising:

the door and the deadbolt.

15. A multipoint door lock system for a door having on its edge a deadbolt and a secondary bore separated from the deadbolt, comprising:

a door frame having a bolt opening adapted for insertion of the deadbolt, the door frame also having a secondary opening;

a latch mounted in the door frame, the latch having a locking recess, the latch taking an activable position when the door is opened, the latch taking a pre-armed position when the door is closed, a door-locking tip of the latch protruding from the secondary opening of the door frame when the door is closed, the door-locking tip entering in the secondary bore when the door is closed; and a translating member mounted in the door frame, the translating member having a proximal end actuated by insertion of the deadbolt in the bolt opening, a distal end of the translating member entering the locking recess of the latch to lock the pivotable latch in its pre-armed position within the secondary bore when the translating member is actuated by insertion of the deadbolt in the bolt opening.

16. The multipoint door lock system of claim 15, comprising:

the door; and the deadbolt.

17. The multipoint door lock system of claim 15, wherein the latch is pivotable and configured to pivot from the activable position to the pre-armed position upon closing of the door and to pivot from the pre-armed position to the activable position upon opening of the door.

18. The multipoint door lock system of claim 15, wherein the latch comprises a door-actuated tip causing the latch to take the pre-armed position upon closing of the door.

19. The multipoint door lock system of claim 18, wherein the door-locking tip causes the door-actuated tip to protrude from the door frame upon opening of the door.

* * * * *